US012467440B2

(12) United States Patent
Wu

(10) Patent No.: US 12,467,440 B2
(45) Date of Patent: Nov. 11, 2025

(54) PORTABLE AIR PUMP

(71) Applicant: Scott Wu, Taichung (TW)

(72) Inventor: Scott Wu, Taichung (TW)

( * ) Notice: Subject to any disclaimer, the term of this patent is extended or adjusted under 35 U.S.C. 154(b) by 108 days.

(21) Appl. No.: 18/440,151

(22) Filed: Feb. 13, 2024

(65) Prior Publication Data

US 2024/0384712 A1 Nov. 21, 2024

(30) Foreign Application Priority Data

May 17, 2023 (TW) ..... 112118276

(51) Int. Cl.

| | |
|---|---|
| ***F04B 33/00*** | (2006.01) |
| ***F04B 9/14*** | (2006.01) |
| ***F04B 39/12*** | (2006.01) |
| ***F04B 39/14*** | (2006.01) |
| ***F04B 53/22*** | (2006.01) |

(52) U.S. Cl.

CPC ..... *F04B 33/00* (2013.01); *F04B 9/14* (2013.01); *F04B 39/123* (2013.01); *F04B 39/14* (2013.01); *F04B 53/22* (2013.01)

(58) Field of Classification Search

CPC ..... B60C 23/105; F04B 9/14; F04B 33/00; F04B 33/005

See application file for complete search history.

(56) References Cited

U.S. PATENT DOCUMENTS

| | | | | | |
|---|---|---|---|---|---|
| 5,016,894 | A * | 5/1991 | Alioto | B62J 11/02 | 152/416 |
| 6,017,201 | A * | 1/2000 | Yang | F04B 25/005 | 417/454 |
| 6,270,327 | B1 * | 8/2001 | Wolz | F04B 33/005 | 417/547 |
| 6,893,232 | B2 * | 5/2005 | Wu | F04B 33/005 | 417/63 |
| 8,297,953 | B2 * | 10/2012 | Wu | F04B 33/005 | 417/467 |
| 2014/0308144 | A1 * | 10/2014 | Hon | F04B 33/005 | 417/559 |

FOREIGN PATENT DOCUMENTS

| | | | | |
|---|---|---|---|---|
| DE | 202007009816 U1 * | 10/2007 | ..... | B62J 1/06 |
| TW | M527494 U | 8/2016 | | |

* cited by examiner

*Primary Examiner* — Jonathan R Matthias
(74) *Attorney, Agent, or Firm* — MUNCY, GEISSLER, OLDS & LOWE, P.C.

(57) ABSTRACT

A portable air pump includes a pumping assembly and an inflating assembly. The pumping assembly includes an inner cylinder and an outer cylinder. The inner cylinder is provided with a first end and a second end, and the outer cylinder is sleeved onto an outer periphery of the inner cylinder from the first end. The inflating assembly includes a sliding member, an inflating tube, and a pivoting member. The sliding member is disposed in the inner cylinder. The inflating tube has a proximal end connected with the pivoting member. The pivoting member is pivotally mounted on the sliding member to be rotatable between an axial position and a radial position. When the pivoting member is in the axial position, the sliding member is movable between a retracted position and an extended position.

8 Claims, 6 Drawing Sheets

PORTABLE AIR PUMP

BACKGROUND OF THE INVENTION

The present invention relates to an air pump and, more particularly, to a portable air pump.

Taiwan Patent NO. TWM527494 discloses an air pump capable of easily assembling, disassembling and receiving a hose. The air pump includes a fixed cylinder, a movable cylinder, and a hose. The movable cylinder is sleeved onto the fixed cylinder and is capable of reciprocating movement relative to the fixed cylinder. The fixed cylinder has a connecting hole and a gate plate inserted into the connecting hole. The movable cylinder has a hose chamber and a detachable cap. The hose can be stored within the hose chamber of the movable cylinder, as well as being taken out from the hose chamber. When the gate plate is in a release position, the hose can extend into the connecting hole. When the gate plate is in a locked position, the gate plate secures the hose in place.

However, the air pump requires reassembly of the hose with each use and the hose must be stored away after use. Furthermore, since the hose is detachable, after the hose is restored into the hose chamber, the opening of the hose chamber still needs to be sealed with the cap, which itself is easily lost, causing considerable inconvenience during the assembly and disassembly of the hose.

Thus, a need exists for a portable air pump to mitigate and/or obviate the above disadvantages.

SUMMARY OF THE INVENTION

In general, this disclosure describes a portable air pump that includes a pumping assembly and an inflating assembly. The pumping assembly includes an inner cylinder and an outer cylinder. The inner cylinder is provided with a first end and a second end. The outer cylinder is sleeved onto an outer periphery of the inner cylinder from the first end. The inflating assembly includes a sliding member, an inflating tube, and a pivoting member. The sliding member is disposed in the inner cylinder and provided with an air outlet hole communicating with the inner cylinder. The inflating tube has a proximal end connected with the pivoting member. The pivoting member is provided with a connecting hole communicating with the inflating tube. The pivoting member is pivotally mounted on the sliding member to be rotatable between an axial position and a radial position. When the pivoting member is in the axial position, the sliding member is movable between a retracted position and an extended position. When the sliding member is in the retracted position, the sliding member is adjacent to the first end and keeps the pivoting member in the axial position. When the sliding member is in the extended position, the sliding member is near the second end. When the pivoting member is in the radial position, the sliding member remains in the extended position, and the connecting hole communicates with the air outlet hole.

In one example, the inflating assembly further includes a valve connector detachably connected to a distal end of the inflating tube opposite to the pivoting member. The valve connector is provided with two opposite connecting ends respectively adapted to attach with a Schrader valve and a Presta valve.

In one example, the sliding member is further provided with two clasping recesses, and two opposite sides of the pivoting member are respectively provided with a lug. The pivoting member is pivotally mounted to the sliding member and located between the two clasping recesses, allowing the lugs of the pivoting member to extend into the two clasping recesses.

In one example, the pumping assembly further includes a head member connected to the second end. The head member has an opening disposed at one end opposite to the inner cylinder, and a side hole disposed at a side and communicating with the opening. When the sliding member is in the extended position and the pivoting member is in the axial position, the inflating assembly protrudes from the head member through the opening. When the pivoting member is in the radial position, the inflating assembly protrudes from the head member through side hole.

In one example, when the sliding member is in the retracted position, the inflating assembly does not protrude from the opening. The pumping assembly further includes a seal cap detachably connected to the opening and adapted to seal the opening.

In one example, the seal cap is connected to an anti-loss portion being flexible and capable of deformation. The anti-loss portion is maintained in connection with the head member.

In one example, the sliding member is provided with an airtight member disposed in the air outlet hole. The pivoting member maintains contact with the airtight member while rotating between the axial and radial positions. When the pivoting member is in the axial position, the connecting hole does not communicate with the air outlet hole.

In one example, the pumping assembly further includes a valve module, a first end cap, and a second end cap. The valve module is disposed in the outer cylinder and connected to the first end. The valve module allows air to irreversibly enter the inner cylinder from the outer cylinder. The first end cap is sleeved onto the outer periphery of the inner cylinder and connected to one end of the outer cylinder. The second end cap is connected to one end of the outer cylinder opposite to the first end cap.

The present invention will become clearer in light of the following detailed description of illustrative embodiments of this invention described in connection with the drawings.

DETAILED DESCRIPTION OF THE INVENTION

Figure 1:
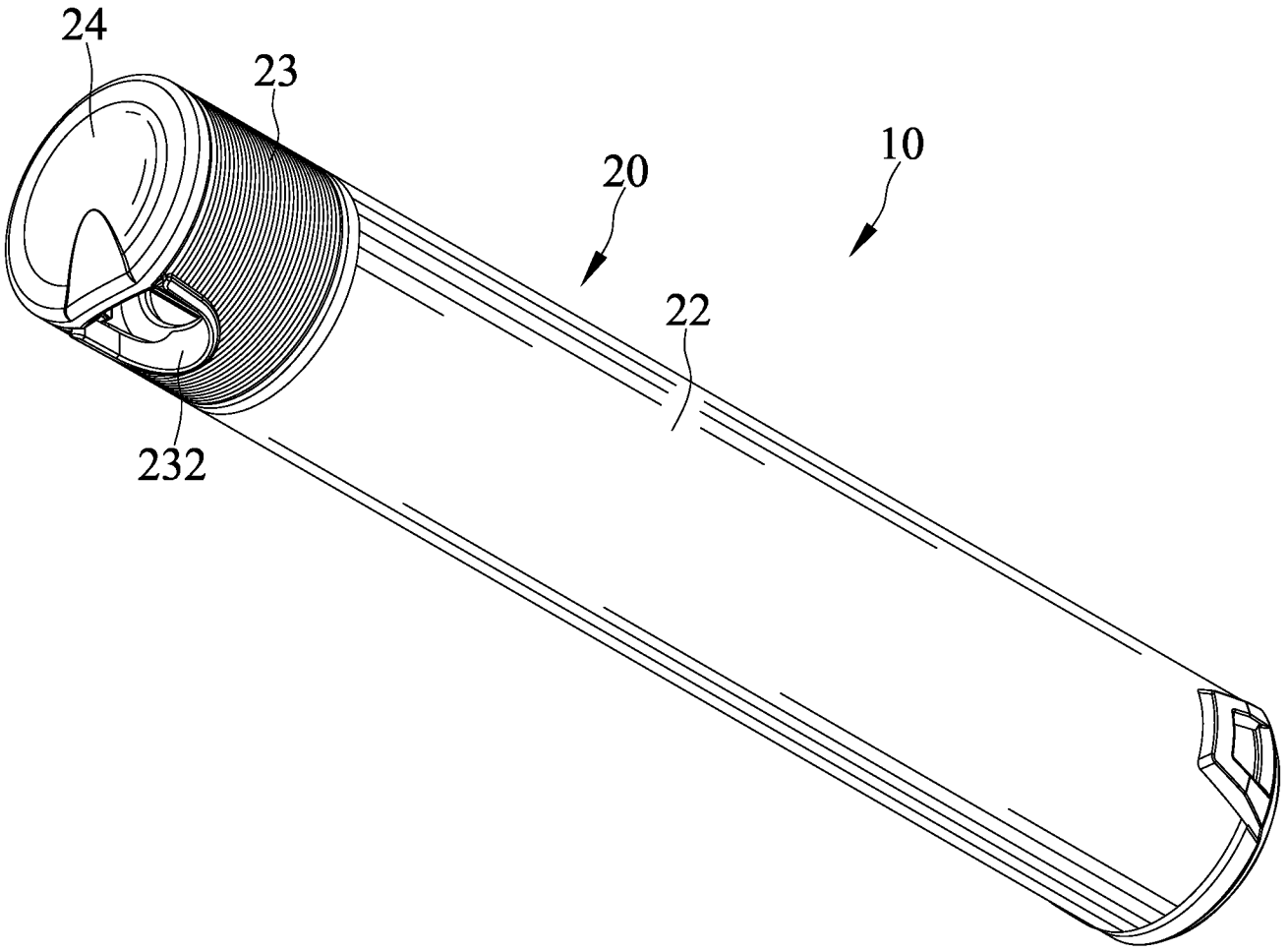
FIG. 1 is a perspective view of a portable air pump of an embodiment according to the present invention.
Figure 2:
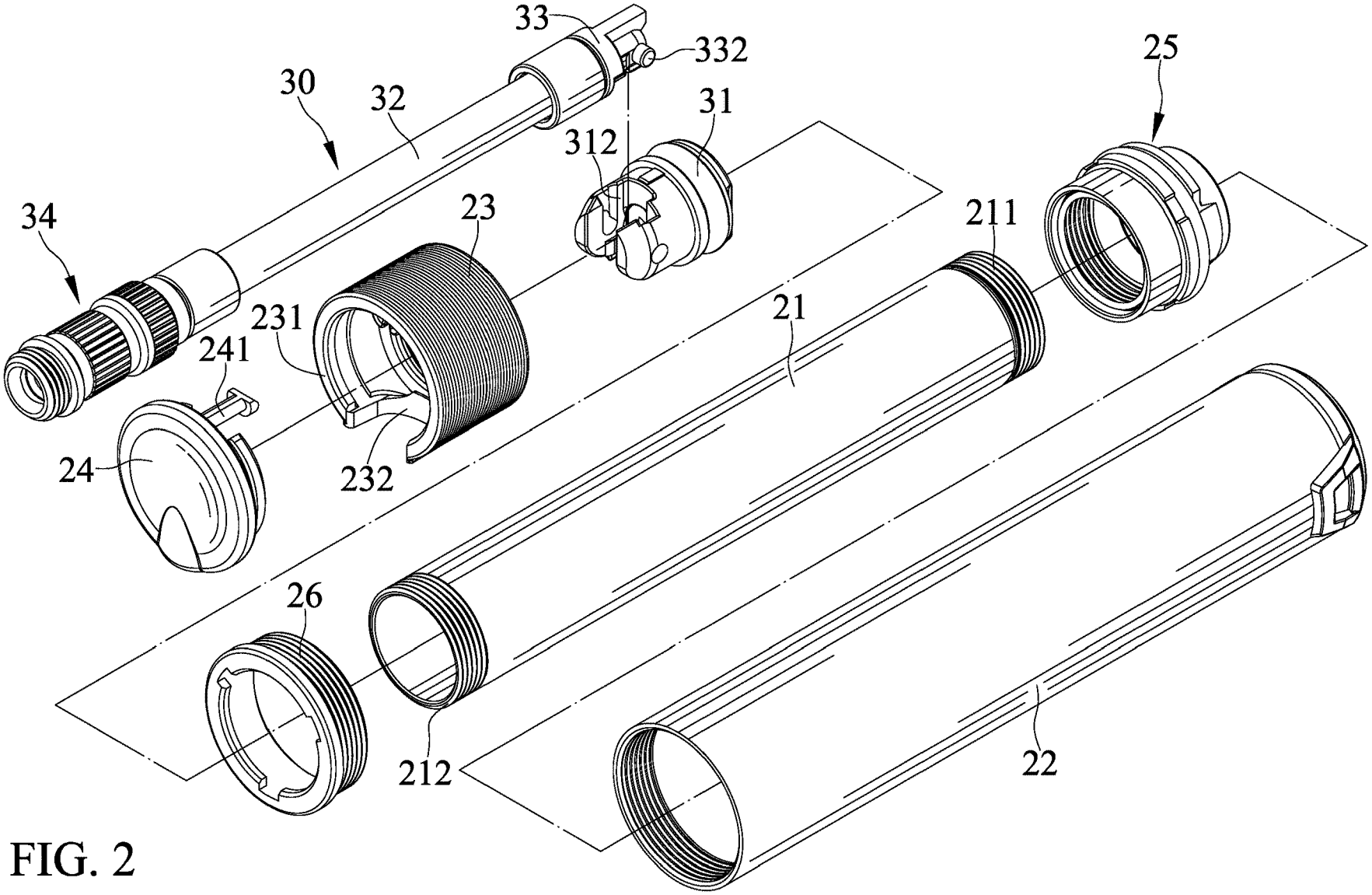
FIG. 2 is an exploded perspective view of the portable air pump of FIG. 1.
Figure 3:
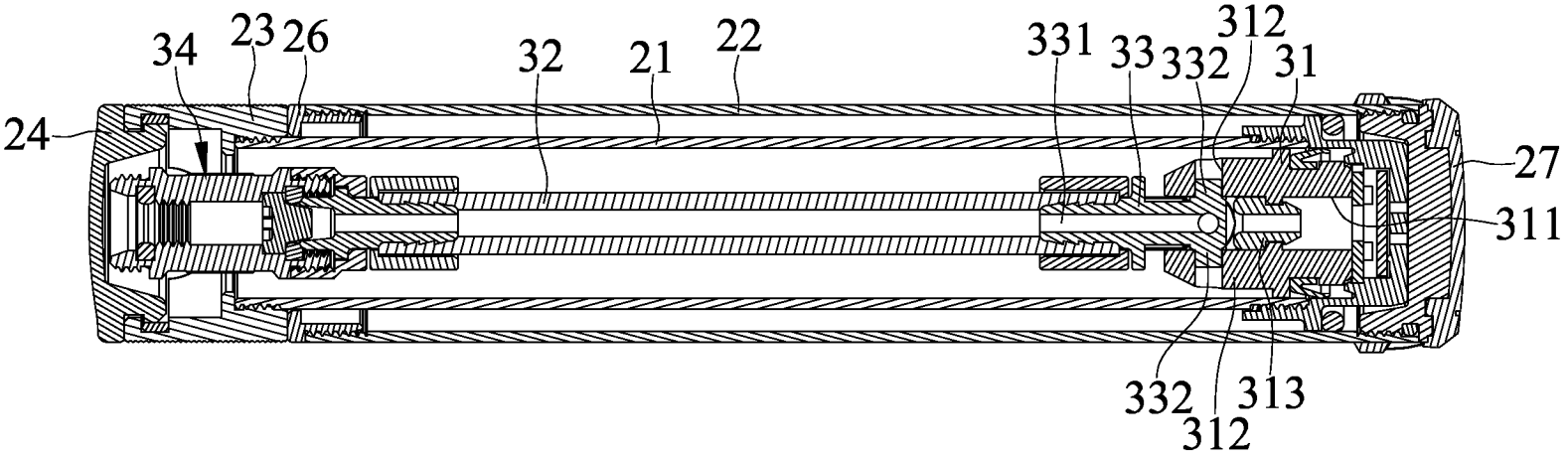
FIG. 3 is a cross sectional view of the portable air pump of FIG. 1 and shows a sliding member in a retracted position.
Figure 4:
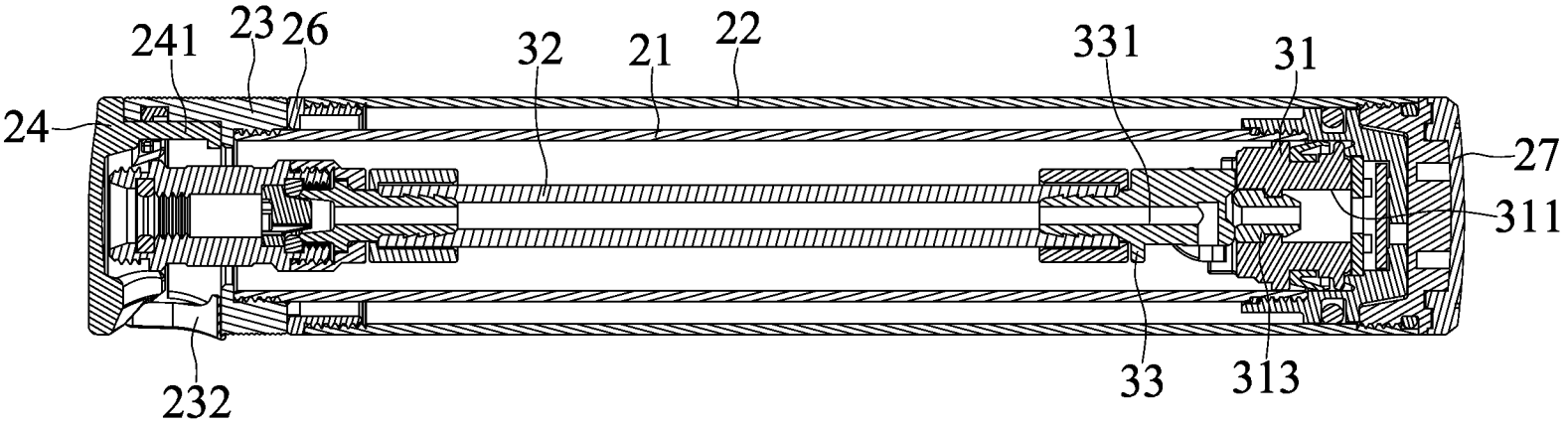
FIG. 4 is another cross sectional view of the portable air pump of FIG. 1 and shows the sliding member in the retracted position.
Figure 5:
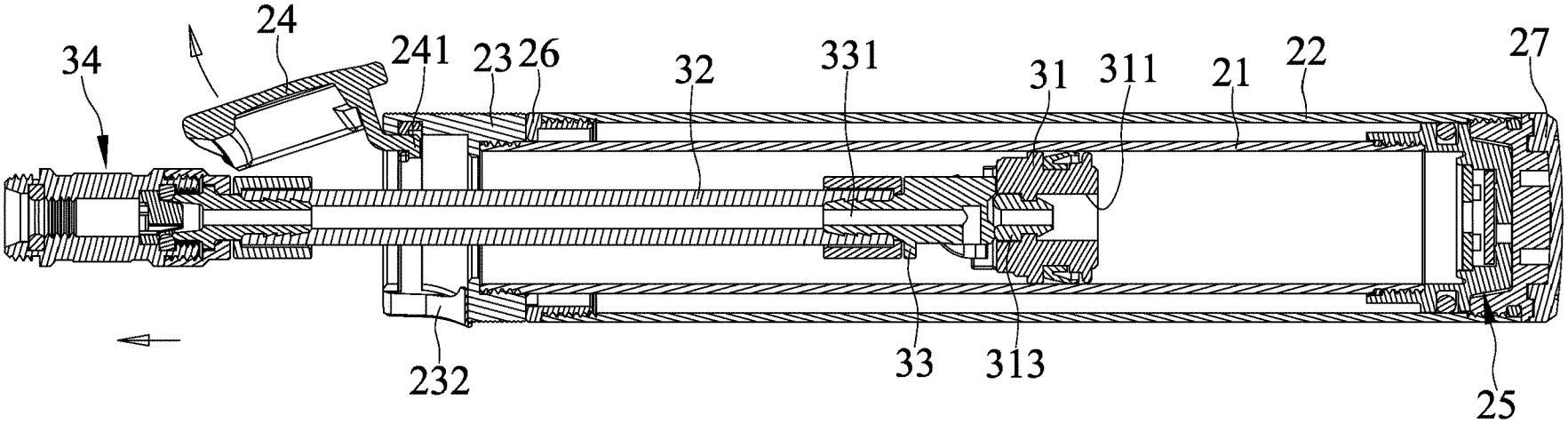
FIG. 5 is a continued view of FIG. 4 and shows the sliding member moved from the retracted position to an extended position.
Figure 6:
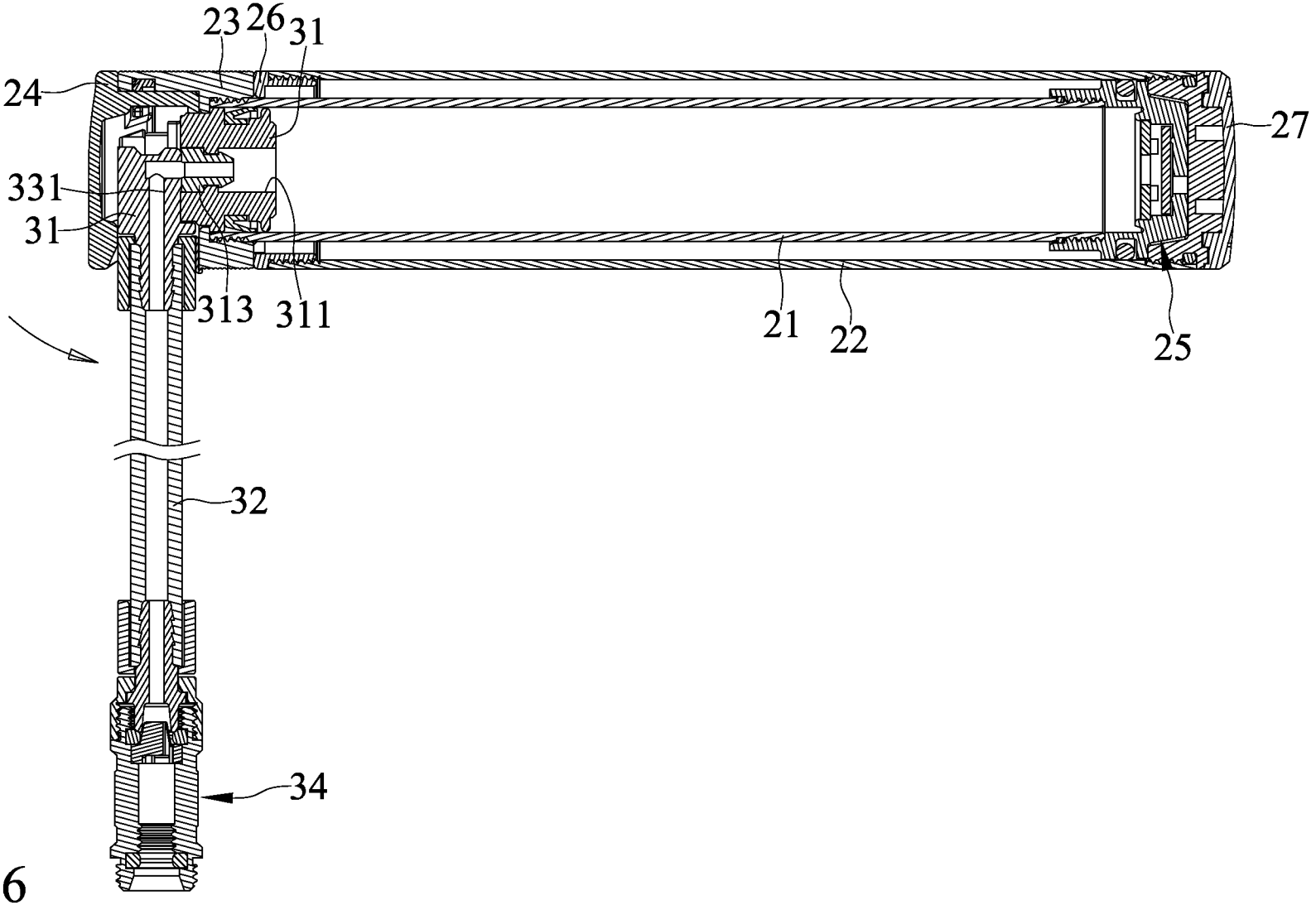
FIG. 6 is a continued view of FIG. 5 and shows a pivoting member rotated form an axial position to a radial position.

FIGS. 1-6 show a portable air pump of an embodiment according to the present invention. The portable air pump 10 includes a pumping assembly 20 and an inflating assembly 30.

The pumping assembly 20 includes an inner cylinder 21 and an outer cylinder 22. The inner cylinder 21 is provided with a first end 211 and a second end 212. The outer cylinder 22 is sleeved onto an outer periphery of the inner cylinder 21 from the first end 211.

The inflating assembly 30 includes a sliding member 31, an inflating tube 32, and a pivoting member 33. The sliding member 31 is disposed in the inner cylinder 21 and provided with an air outlet hole 311 communicating with the inner cylinder 21. The inflating tube 32 has a proximal end connected with the pivoting member 33. The pivoting member 33 is provided with a connecting hole 331 communicating with the inflating tube 32. The pivoting member 33 is pivotally mounted on the sliding member 31 to be rotatable between an axial position and a radial position. When the pivoting member 33 is in the axial position, the sliding member 31 is movable between a retracted position and an extended position. When the sliding member 31 is in the retracted position, the sliding member 31 is adjacent to the first end 211 and keeps the pivoting member 33 in the axial position. When the sliding member 31 is in the extended position, the sliding member 31 is near the second end 212. When the pivoting member 33 is in the radial position, the sliding member 31 remains in the extended position, and the connecting hole 331 communicates with the air outlet hole 311.

The inflating assembly 30 further includes a valve connector 34 detachably connected to a distal end of the inflating tube 32 opposite to the pivoting member 33. The valve connector 34 is provided with two opposite connecting ends respectively adapted to attach with a Schrader valve and a Presta valve.

The sliding member 31 is further provided with two clasping recesses 312, and two opposite sides of the pivoting member 33 are respectively provided with a lug 332. The pivoting member 33 is pivotally mounted to the sliding member 31 and located between the two clasping recesses 312, allowing the lugs 332 of the pivoting member 33 to extend into the two clasping recesses 312.

The pumping assembly 20 further includes a head member 23 connected to the second end 212. The head member 23 has an opening 231 disposed at one end opposite to the inner cylinder 21, and a side hole 232 disposed at a side and communicating with the opening 231. When the sliding member 31 is in the extended position and the pivoting member 33 is in the axial position, the inflating assembly 30 protrudes from the head member 23 through the opening 231. When the pivoting member 33 is in the radial position, the inflating assembly 30 protrudes from the head member 23 through side hole 232.

When the sliding member 31 is in the retracted position, the inflating assembly 30 does not protrude from the opening 231. The pumping assembly 20 further includes a seal cap 24 detachably connected to the opening 231 and adapted to seal the opening 231.

The seal cap 24 is connected to an anti-loss portion 241 being flexible and capable of deformation. The anti-loss portion 241 is maintained in connection with the head member 23.

The sliding member 31 is provided with an airtight member 313 disposed in the air outlet hole 311. The pivoting member 33 maintains contact with the airtight member 313 while rotating between the axial and radial positions. When the pivoting member 33 is in the axial position, the connecting hole 331 does not communicate with the air outlet hole 311.

The pumping assembly 20 further includes a valve module 25, a first end cap 26, and a second end cap 27. The valve module 25 is disposed in the outer cylinder 22 and connected to the first end 211. The valve module 25 allows air to irreversibly enter the inner cylinder 21 from the outer cylinder 22. The first end cap 26 is sleeved onto the outer periphery of the inner cylinder 21 and connected to one end of the outer cylinder 22. The second end cap 27 is connected to one end of the outer cylinder 22 opposite to the first end cap 26.

Therefore, the inflating assembly 30 is foldable to facilitate the portability of the air pump 10. When the sliding member 31 is in the retracted position, the inflating assembly 30 does not protrude from the pumping assembly 20, preventing accidental pulling out of the inflating assembly 30, and convenient for the user to retract and extend without the need to reassemble the members of the air pump 10.

Although specific embodiments have been illustrated and described, numerous modifications and variations are still possible without departing from the scope of the invention. The scope of the invention is limited by the accompanying claims.

The invention claimed is:

1. A portable air pump comprising:

a pumping assembly including an inner cylinder and an outer cylinder, wherein the inner cylinder is provided with a first end and a second end, and wherein the outer cylinder is sleeved onto an outer periphery of the inner cylinder from the first end; and an inflating assembly including a sliding member, an inflating tube, and a pivoting member, wherein the sliding member is disposed in the inner cylinder and provided with an air outlet hole communicating with the inner cylinder, wherein the inflating tube has a proximal end connected with the pivoting member, wherein the pivoting member is provided with a connecting hole communicating with the inflating tube, wherein the pivoting member is pivotally mounted on the sliding member to be rotatable between an axial position and a radial position;

wherein when the pivoting member is in the axial position, the sliding member is movable between a retracted position and an extended position;

wherein when the sliding member is in the retracted position, the sliding member is adjacent to the first end and keeps the pivoting member in the axial position;

wherein when the sliding member is in the extended position, the sliding member is near the second end;

wherein when the pivoting member is in the radial position, the sliding member remains in the extended position, and the connecting hole communicates with the air outlet hole.

2. The portable air pump as claimed in claim 1, wherein the inflating assembly further includes a valve connector detachably connected to a distal end of the inflating tube opposite to the pivoting member, wherein the valve connector is provided with two opposite connecting ends respectively adapted to attach with a Schrader valve and a Presta valve.

3. The portable air pump as claimed in claim 1, wherein the sliding member is further provided with two clasping recesses, wherein two opposite sides of the pivoting member are respectively provided with a lug, and wherein the pivoting member is pivotally mounted to the sliding member and located between the two clasping recesses, allowing the lugs of the pivoting member to extend into the two clasping recesses.

4. The portable air pump as claimed in claim 1, wherein the pumping assembly further includes a head member connected to the second end, and wherein the head member has an opening disposed at one end opposite to the inner cylinder, and a side hole disposed at a side and communicating with the opening;

wherein when the sliding member is in the extended position and the pivoting member is in the axial position, the inflating assembly protrudes from the head member through the opening;

wherein when the pivoting member is in the radial position, the inflating assembly protrudes from the head member through side hole.

5. The portable air pump as claimed in claim 4, wherein when the sliding member is in the retracted position, the inflating assembly does not protrude from the opening, and wherein the pumping assembly further includes a seal cap detachably connected to the opening and adapted to seal the opening.

6. The portable air pump as claimed in claim 5, wherein the seal cap is connected to an anti-loss portion being flexible and capable of deformation, and wherein the anti-loss portion is maintained in connection with the head member.

7. The portable air pump as claimed in claim 1, wherein the sliding member is provided with an airtight member disposed in the air outlet hole, and wherein the pivoting member maintains contact with the airtight member while rotating between the axial and radial positions;

wherein when the pivoting member is in the axial position, the connecting hole does not communicate with the air outlet hole.

8. The portable air pump as claimed in claim 1, wherein the pumping assembly further includes a valve module, a first end cap, and a second end cap, wherein the valve module is disposed in the outer cylinder and connected to the first end, wherein the valve module allows air to irreversibly enter the inner cylinder from the outer cylinder, wherein the first end cap is sleeved onto the outer periphery of the inner cylinder and connected to one end of the outer cylinder, and wherein the second end cap is connected to one end of the outer cylinder opposite to the first end cap.

* * * * *